US005513725A

United States Patent [19]

Michael

[11] Patent Number: 5,513,725

[45] Date of Patent: May 7, 1996

[54] REMOTE SUMMONING OF ELEVATORS

[76] Inventor: Micha Michael, 1 Shaul Avigur, 69397 Tel Aviv, Israel

[21] Appl. No.: 365,254

[22] Filed: Dec. 28, 1994

[51] Int. Cl.[6] ..... B66B 7/00

[52] U.S. Cl. ..... 187/414; 187/277

[58] Field of Search ..... 187/414, 277, 187/391, 290, 289

[56] References Cited

U.S. PATENT DOCUMENTS 3,500,963 3/1970 Beutler ..... 187/289

FOREIGN PATENT DOCUMENTS 2733441 2/1979 Germany ..... 187/277

4256391 2/1990 Japan .

*Primary Examiner*—Kenneth Noland

*Attorney, Agent, or Firm*—Mark M. Friedman

[57] ABSTRACT

An elevator system, which includes one or more elevators and an elevator controller for controlling the operation of the elevator. The system further includes at least one distant summons button for summoning said elevator, the button being operationally connected to said elevator controller, either by electrical connection or through wireless transmission. The distant summons button is located away from the immediate area near the elevator, for example, in an apartment or an office.

6 Claims, 1 Drawing Sheet

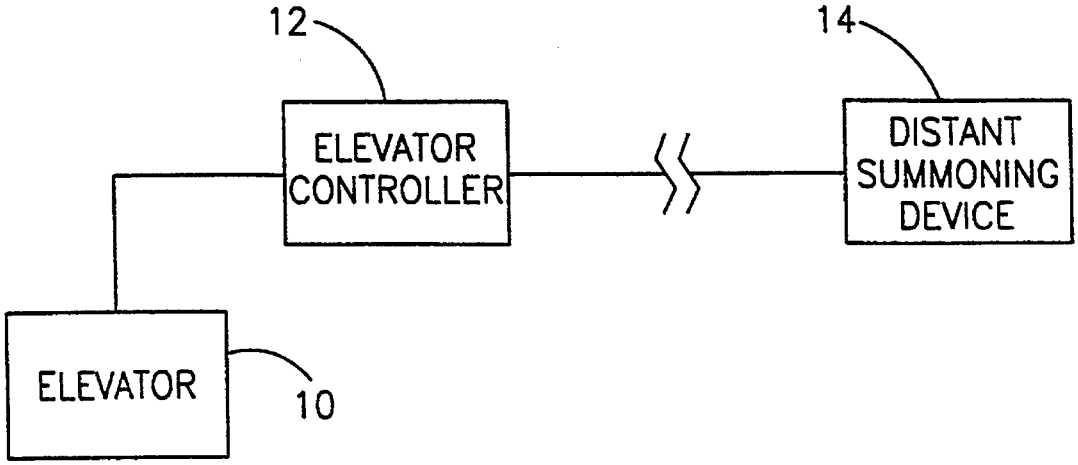
FIGURE

REMOTE SUMMONING OF ELEVATORS

FIELD AND BACKGROUND OF THE INVENTION

The present invention relates to a system for summoning an elevator and, more particularly, to a system which will shorten or eliminate the delay which normally occurs between the arrival of the user to the area immediately in front of the elevator and the arrival of the elevator.

Conventional elevator systems include one or two summons buttons located in the vicinity of the elevator on every floor. Typically, these buttons, which usually include one for summoning the elevator for going up and one for going down, are mounted on the wall just a few centimeters of the elevator door.

To summon an elevator, the user approaches the area immediately in front of the elevator shaft and depresses one or the other of the two elevator summons buttons. The summons is fed to the elevator controller which provides commands to an elevator to stop on the floor from which the summons was issued when the elevator is heading in the desired direction.

Depending on the precise location and direction of the elevators at the instant the summons is effected and on the type and size of elevator system involved, the wait from the instant the summons button is depressed until the elevator arrives could lake anywhere from a few seconds to several minutes. The wait, especially when it spans several minutes, is wasteful of the user's time and can be quite aggravating.

There is thus a widely recognized need for, and it would be highly advantageous to have, an elevator system which would significantly reduce or eliminate the waiting time between the summoning of an elevator and its arrival.

SUMMARY OF THE INVENTION

According to the present invention there is provided an elevator system, comprising: (a) at least one elevator; (b) an elevator controller for controlling the operation of the at least one elevator; and (c) at least one distant summons button, operationally connected to the elevator controller, for summoning the elevator.

According to further features in preferred embodiments of the invention described below, the elevator system is installed in a residential building and the distant summons buttons are located inside the various apartment and/or near the doorkeeper, or the system is installed in an office building and the distant summons buttons are located in the various offices.

According to still further features in the described preferred embodiments, the distant summons buttons are electrically or wirelessly connected to the elevator controller.

The present invention successfully addresses the shortcomings of the presently known configurations by providing a distantly located elevator summons button which is capable of significantly reducing the amount of time spent waiting for an elevator.

The present invention discloses a novel system which includes distantly located elevator summons buttons which allow the user, or someone acting on his behalf, to summon the elevator before the user physically reaches the immediate vicinity of the elevator door.

BRIEF DESCRIPTION OF THE DRAWINGS

The invention is herein described, by way of example only, with reference to the accompanying drawings, wherein the sole FIGURE schematically depicts a system according to the present invention.

DESCRIPTION OF THE PREFERRED EMBODIMENTS

The present invention is of a system which makes it possible to summon an elevator from a distant location.

The principles and operation of a system according to the present invention may be better understood with reference to the drawing and the accompanying description.

Referring now to the drawings, FIG. 1 schematically illustrates a generalized system according to the present invention. The system includes a conventional elevator 10 of any suitable design. The operations of elevator 10 are controlled by a suitable controller 12. Controller 12 provides commands which determine the location of elevator 10 and the open/close status of the elevator doors, among other things.

A system according to the present invention is characterized in that it includes summons buttons which are distant, i.e., which are removed from the immediate vicinity of the elevator door, as in conventional systems. That is, the distant summons buttons are not within a few centimeters of the elevator door but are, instead, located from about three to about 100 meters and more from the immediate vicinity of the elevator door on the floor in question.

The distant summons buttons 14 may be used in place of the conventionally mounted summons buttons in the vicinity of the elevator. Preferably, the distant summons buttons are included in addition to the conventionally summons buttons in the immediate vicinity of the elevator shaft on each floor.

The distant summons buttons, typically a pair of buttons—one for going up and one for coming down, are operationally connected to the elevator controller so that depressing such a distant summons button is operationally equivalent to pressing a conventions summons buttons located in the immediate vicinity of the elevator shaft. The connection between the distant summons buttons and the elevator controller can be wireless transmission. Preferably, the connection is by electrical wire.

Numerous applications for a system according to the present invention may be envisioned. For example, the elevator system in a residential building, such as an apartment building or condominium, could be enhanced with the addition of distant summons buttons inside each of the flats or apartments. This will make it possible for a resident or guest who is about to leave to summon the elevator before reaching the immediate vicinity of the elevator and will significantly reduce, or even eliminate, the amount of time spent waiting for the elevator to arrive.

Such distant elevator summons buttons could also be located near the entrance of a building and/or near the doorkeeper or concierge so that as soon as a resident or guest enters the lobby of the residential building an elevator can be summoned. Furthermore, a distant summons button at the entrance of the underground parking garage could significantly shorten the wait for the elevator.

Similarly, in office buildings the individual offices are often quite distant from the elevator. Distant summons buttons located near the receptionist will make it possible for an elevator to be summoned when someone is about to leave the office for the elevator.

Similar applications can be envisioned for hotels, hospitals and the like.

While the invention has been described with respect to a limited number of embodiments, it will be appreciated that many variations, modifications and other applications of the invention may be made.

What is claimed is:

1. An elevator system, comprising:

(a) at least one elevator;

(b) an elevator controller for controlling the operation of said at least one elevator; and (c) means to shorten the delay between the arrival of an elevator user and arrival of the elevator comprising at least one distant summons button, operationally connected to said elevator controller, for conventionally summoning said elevator, said at least one distant summons button being electrically connected through electrical wire to said elevator controller.

2. A system as in claim 1, wherein the elevator system is installed in a residential building and said at least one distant summons button is located inside an apartment.

3. A system as in claim 1, wherein the elevator system is installed in a residential building and said at least one distant summons button is located near a doorkeeper.

4. A system as in claim 1, wherein the elevator system is installed in a residential building and said at least one distant summons button is located in the vicinity of an underground garage.

5. A system as in claim 1, wherein the elevator system is installed in a residential building and said at least one distant summons button is located near the entrance to a building.

6. A system as in claim 1, wherein the elevator system is installed in an office building and said at least one distant summons button is located inside an office.

* * * * *